US010071287B2

(12) United States Patent
Dedvukaj et al.

(10) Patent No.: US 10,071,287 B2
(45) Date of Patent: Sep. 11, 2018

(54) BALANCE BOARD

(71) Applicants: Lindon Dedvukaj, Oxford, MI (US); David Boyer, Oxford, MI (US)

(72) Inventors: Lindon Dedvukaj, Oxford, MI (US); David Boyer, Oxford, MI (US)

(73) Assignee: Exercise Innovation LLC, Oxford, MI (US)

( * ) Notice: Subject to any disclaimer, the term of this patent is extended or adjusted under 35 U.S.C. 154(b) by 0 days.

(21) Appl. No.: 15/042,566

(22) Filed: Feb. 12, 2016

(65) Prior Publication Data

US 2017/0232302 A1 Aug. 17, 2017

(51) Int. Cl.

| | |
|---|---|
| ***A63B 21/02*** | (2006.01) |
| ***A63B 26/00*** | (2006.01) |
| ***A63B 21/04*** | (2006.01) |
| ***A63B 22/16*** | (2006.01) |
| *A63B 21/055* | (2006.01) |
| *A63B 23/035* | (2006.01) |
| *A63B 21/00* | (2006.01) |

(52) U.S. Cl.

CPC ..... *A63B 26/003* (2013.01); *A63B 21/0442* (2013.01); *A63B 22/16* (2013.01); *A63B 21/0552* (2013.01); *A63B 21/4035* (2015.10); *A63B 21/4043* (2015.10); *A63B 23/03541* (2013.01); *A63B 2225/09* (2013.01)

(58) Field of Classification Search

CPC ..... A63B 22/14; A63B 22/16; A63B 22/18; A63B 26/003; A63B 2026/006; A63B 21/4047; A63B 21/4049; A63B 21/4034; A63B 21/04; A63B 21/0442; A63B 21/055; A63B 21/0552

See application file for complete search history.

(56) References Cited

U.S. PATENT DOCUMENTS

| | | | | | |
|---|---|---|---|---|---|
| 2,253,996 | A | * | 8/1941 | Bechman | A63B 22/16 482/146 |
| 3,416,792 | A | * | 12/1968 | Morgan | A63B 22/16 482/146 |
| 3,895,794 | A | * | 7/1975 | England | A63B 22/16 482/146 |
| 4,759,542 | A | | 7/1988 | Hudec | |
| 4,787,630 | A | | 11/1988 | Watson et al. | |
| 4,822,039 | A | * | 4/1989 | Gonzales | A63B 22/16 482/128 |
| 4,911,440 | A | * | 3/1990 | Hyman | A63B 22/16 482/146 |

(Continued)

*Primary Examiner* — Gregory Winter
(74) *Attorney, Agent, or Firm* — Fishman Stewart PLLC

(57) ABSTRACT

A balance board system may include a platform, a pivot member, a first bodily engagement member, and a second bodily engagement member. The platform may include a planar body with upper and lower sides and that extends between a first end and a second end. The platform may have a central portion between the first and second ends. The pivot member may be located on the lower side and the central portion of the platform. The first bodily engagement member may be located on the upper side and adjacent the first end of the platform. The second bodily engagement member may be located on the upper side and adjacent the second end of the platform. The first and second bodily engagement members may be configured with respective incline angles relative to the platform.

20 Claims, 6 Drawing Sheets

(56) References Cited

U.S. PATENT DOCUMENTS

| | | | | |
|---|---|---|---|---|
| 5,320,593 | A * | 6/1994 | Heatwole | A63B 26/003 482/146 |
| 5,391,134 | A * | 2/1995 | Heatwole | A63B 21/0004 482/123 |
| 5,611,765 | A | 3/1997 | Koch, Jr. | |
| 5,897,474 | A * | 4/1999 | Romero | A63B 22/14 446/396 |
| 6,705,977 | B1 * | 3/2004 | Ziak | A63B 21/0004 472/135 |
| 7,833,145 | B2 | 11/2010 | Ko | |
| 8,360,943 | B2 * | 1/2013 | Smith | A63B 21/0004 482/146 |
| 8,734,308 | B1 | 5/2014 | Joslin | |
| 8,888,669 | B2 * | 11/2014 | Dunegan | A63B 21/0442 482/123 |
| 2004/0142802 | A1 * | 7/2004 | Greenspan | A61H 1/0237 482/146 |
| 2014/0274585 | A1 * | 9/2014 | Huang | A63B 23/10 482/79 |
| 2015/0190679 | A1 * | 7/2015 | Carbone | A63B 26/003 482/146 |

* cited by examiner

BALANCE BOARD

BACKGROUND

Proprioception is the ability of a body to sense the position of body parts and move the body parts in response to stimulation. Stability is the degree to which a body positions its center of gravity to resist movement. Improving the proprioception and stability of the body through proprioceptive or balance training may reduce improper loading and injuries to areas of the body such as the spine (e.g., the lumbar spine) and the extremities (e.g., arms and legs). For example, proprioceptive training has been shown to significantly reduce incidence of knee injuries, specifically with respect to the anterior cruciate ligament (ACL). Thus, there is a need for a system that improves proprioceptive training, thereby leading to improved proprioception and/or stability of the body. Further, there is a need for a system that promotes improved body mobility, strength, speed, and/or power.

BRIEF DESCRIPTION OF THE DRAWINGS

While the claims are not limited to a specific illustration, an appreciation of the various aspects is best gained through a discussion of various examples thereof. Referring now to the drawings, exemplary illustrations are shown in detail. Although the drawings represent the illustrations, the drawings are not necessarily to scale and certain features may be exaggerated to better illustrate and explain an innovative aspect of an example. Further, the exemplary illustrations described herein are not intended to be exhaustive or otherwise limiting or restricted to the precise form and configuration shown in the drawings and disclosed in the following detailed description. Exemplary illustrations are described in detail by referring to the drawings as follows:

DETAILED DESCRIPTION

A balance board system may comprise a platform, a pivot member, a first bodily engagement member, and a second bodily engagement member. The platform may include a planar body. The pivot member may be located on a lower side and a central portion of the platform. The first bodily engagement member may be located on an upper side and adjacent the first end of the platform. The second bodily engagement member may be located on the upper side and adjacent a second end of the platform.

Methods of using a balance board are also contemplated. A method may include providing a platform, a pivot member, a first bodily engagement member, and a second bodily engagement member. The method may further include engaging a first limb of a user with the first bodily engagement member, engaging a second limb of the user with the second bodily engagement member, and balancing a body weight of the user about the pivot member.

Figure 1:
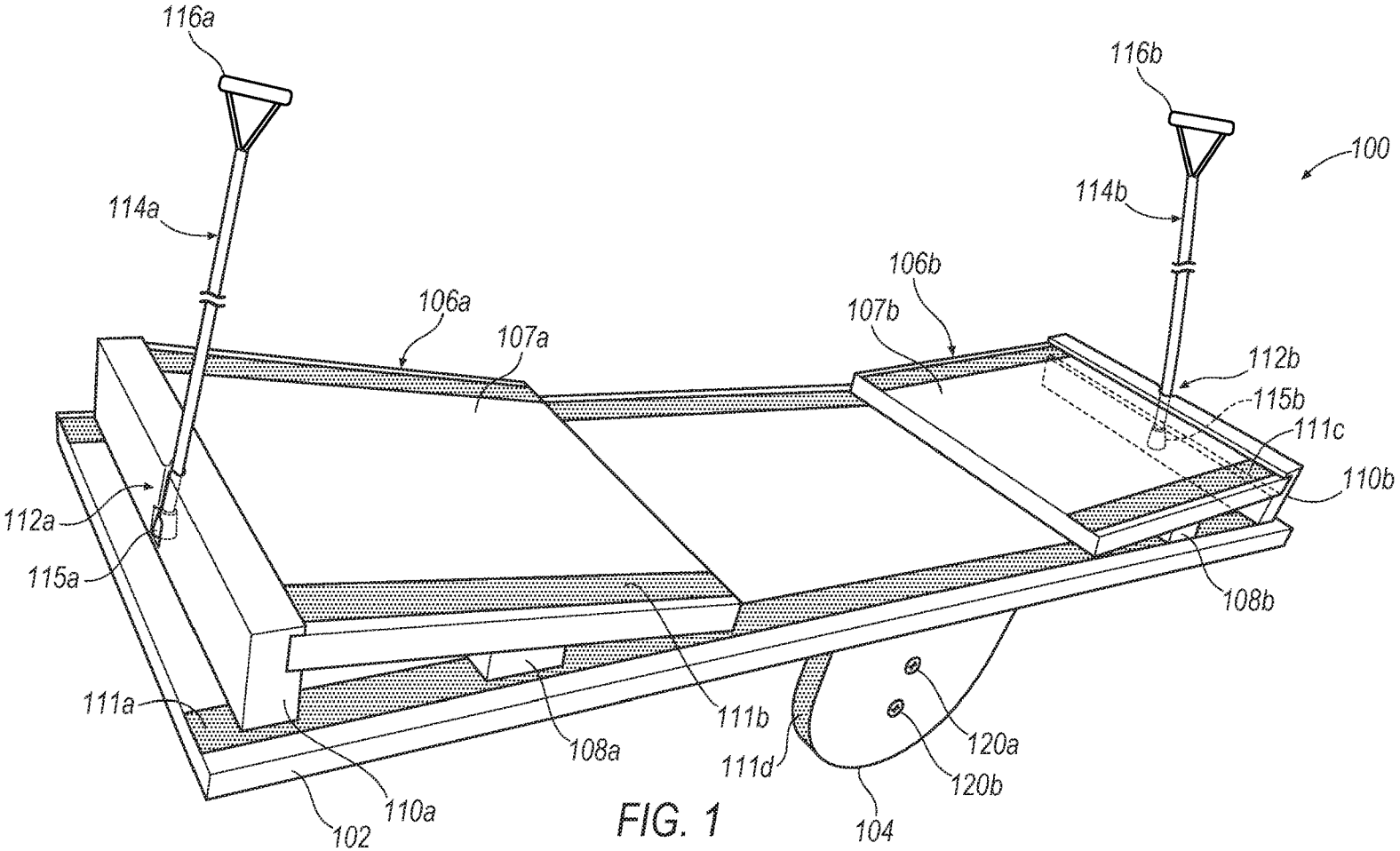
FIG. 1 illustrates an isometric view of a balance board system of the present disclosure.

FIG. 1 illustrates balance board system 100. System 100 may include a platform 102, a pivot member 104, a first bodily engagement member 106*a*, and a second bodily engagement member 106*b*. The first and second bodily engagement members 106*a*, 106*b* may include respective upper surfaces 107*a*, 107*b*, middle supports 108*a*, 108*b*, and end supports 110*a*, 110*b*. The platform 102, pivot member 104, and upper surfaces 107*a*, 107*b* may include one or a plurality of respective textured areas or strips 111*a*, 111*b*, 111*c*, 111*d* to increase traction relative to one or more body parts of a user and/or surrounding surfaces, e.g., the ground or other exercise or rehabilitation devices. System 100 and its components may be made of one or any combination of materials such as plastic, metal, wood, fabric, rubber, inflatable elastic materials, foam rubber, and closed cell foam. System 100 may include fasteners 120*a*, 120*b* configured to secure the pivot member 104 relative to a transverse support connected to the platform 102, as discussed in further detail below. System 100 may take many different forms and include multiple and/or alternate components. While exemplary system 100 is shown in FIG. 1, the exemplary components illustrated in FIG. 1 are not intended to be limiting. Indeed, additional or alternative components or implementations may be used.

System 100 may further include connectors 112*a*, 112*b* (e.g., first and second attachment members) configured to receive and secure respective first and second resistance bands 114*a*, 114*b*, e.g., having respective first and second handles 116*a*, 116*b*. The first and second handles 116*a*, 116*b* may be configured to engage first and second upper limbs or hands of a user. The first and second connecting ends 115*a*, 115*b* may be configured to engage and be received in connectors 112*a*, 112*b*. For example, the connectors 112*a*, 112*b* may include a groove structure that is configured to receive a conical structure of respective first and second connecting ends 115*a*, 115*b* as shown in FIG. 1. The groove structure may be part of end supports 110*a*, 110*b* or a separate component secured to the side or top of end supports 110*a*, 110*b*. As another example, the connectors 112*a*, 112*b* may include a C-shaped structure configured to receive a looped structure of respective first and second connecting ends 115*a*, 115*b*, as described in further detail below with respect to FIG. 2. As another example, the looped structure of respective first and second connecting ends 115*a*, 115*b* may engage respective connectors 112*a*, 112*b* having a hook or loop structure and external threads to engage and be threaded into internal threads of end supports 110*a*, 110*b*. Alternatively or in addition, the first and second connecting ends 115*a*, 115*b* may be releasably received connectors 112*a*, 112*b* (e.g., a press or snap fit connection) or permanently joined with connectors 112*a*, 112*b* (e.g., a chemical or thermal bond connection).

As shown in FIG. 1, the platform 102 may include a planar body with upper and lower sides. The platform 102 may extend between a first end configured to receive first engagement member 106*a* and a second end configured to receive second engagement member 106*b*, e.g., on the upper side of platform 102. The platform 102 may have a central portion between the first and second ends, e.g., having the pivot member 104 on the lower side. The pivot member 104 may include linear sidewalls. Alternatively or in addition, the pivot member 104 may include a round or curved lower surface. The pivot member 104 may be configured to rotate or oscillate the platform 102 about the lower surface of the pivot member 104, e.g., based on the position of the center of gravity of the user. Thus, the system 100 may urge the user to balance the platform 102 toward a level condition, thereby enhancing proprioception and/or stability of the user.

The first and second bodily engagement members 106*a*, 106*b* may be shaped and configured as first and second wedges. The first and second bodily engagement members 106*a*, 106*b* may include upper support surfaces 107*a*, 107*b* configured to provide incline angles 122*a*, 122*b* relative to the platform 102. The incline angles 122*a*, 122*b* may be at any fixed or selectively adjustable angle with respect to platform 102. The incline angles 122*a*, 122*b* may be at about an angle of or angular range between any of 5, 10, 15, 17, 20, 25, 30, and 45 degrees, e.g., an angle of about 17 degrees or an angular range from about 15 to about 20 degrees. See FIG. 2. The first and second bodily engagement members 106*a*, 106*b* may include corresponding structures such as rigid or hinged connections to accommodate such fixed or adjustable incline angles. For example, the first and second engagement members 106*a*, 106*b* may include a selectable adjustment mechanism (e.g., threaded or pneumatic) configured to allow the user to selectively adjust and optimize the include angles 122*a*, 122*b* with respect to the platform 102.

The first and second bodily engagement members 106*a*, 106*b* may be configured to pivot platform 102 about the pivot member 104. The first and second bodily engagement members 106*a*, 106*b* may be arranged on opposites sides of the pivot member 104. The first and second bodily engagement members 106*a*, 106*b* may include respective upper surfaces 107*a*, 107*b*, middle supports 108*a*, 108*b*, and end supports 110*a*, 110*b*. The first and second bodily engagement members 106*a*, 106*b* may be configured to engage first and second limbs of a user and urge the user to stabilize the platform in a level condition. For example, the first and second limbs may include first and second upper limbs such as arms or hands of the user. As another example, the first and second limbs may include first and second lower limbs such as legs or feet of the user. The first and second bodily engagement members 106*a*, 106*b* may include respective first and second upper surfaces 107*a*, 107*b*. The first and second engagement members 106*a*, 106*b* may include first and second middle support members 108*a*, 108*b* and respective first and second end support members 110*a*, e.g., to support the first and second upper surfaces 107, 107*b*.

Figure 2:
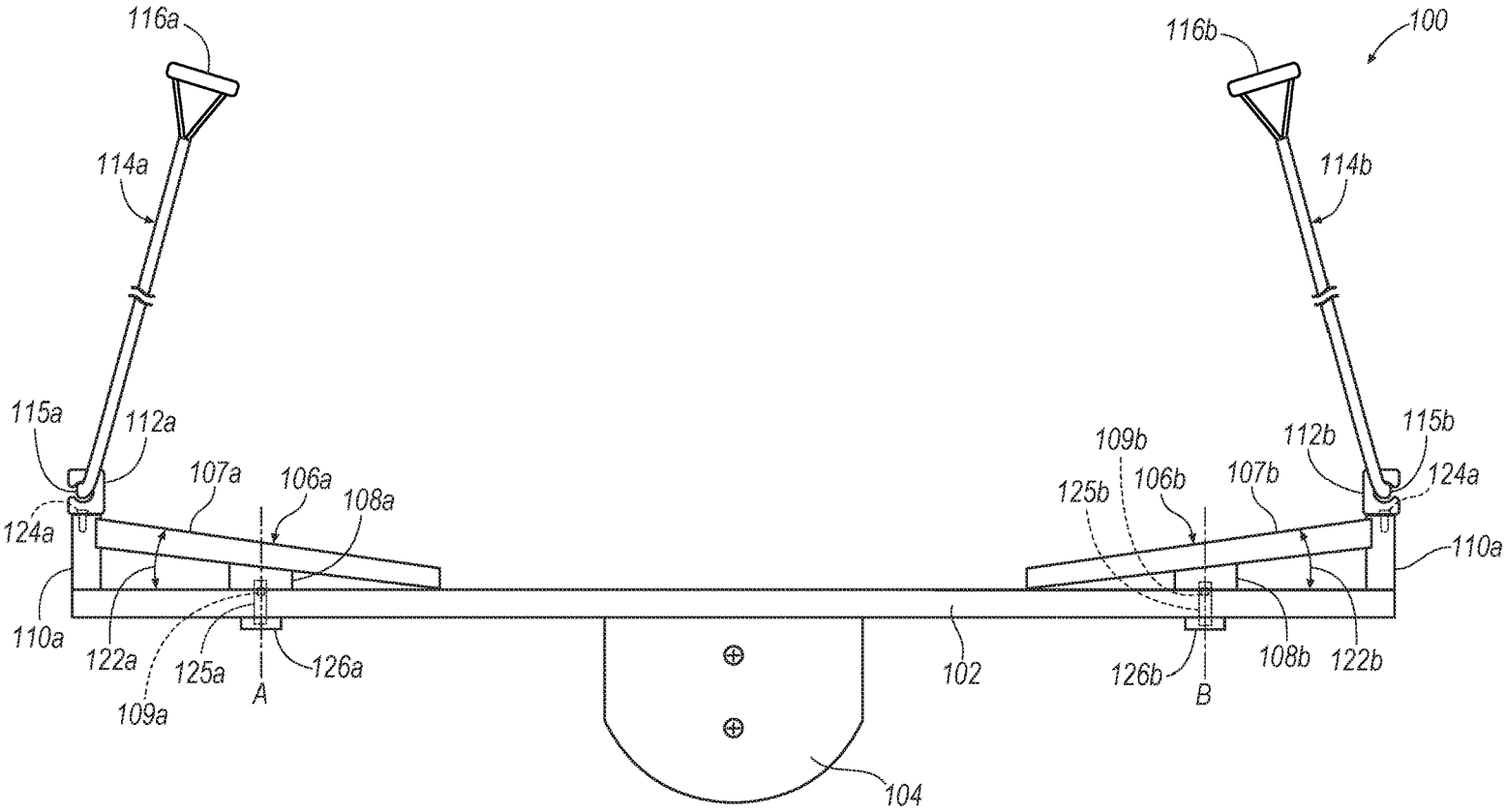
FIG. 2 illustrates a front view of the balance board system.

As shown in FIG. 2, connectors 112*a*, 112*b* may be configured to receive and secure respective first and second resistance bands 114*a*, 114*b*, e.g., having respective first and second handles 116*a*, 116*b*. Connectors 112*a*, 112*b* may be secured with respective fasteners 124*a*, 124*b* to the first and second bodily engagement members 106*a*, 106*b*, e.g., specifically end supports 110*a*, 110*b*. Exemplary connectors 112*a*, 112*b* may include a C-shape as shown or any other structure configured to releasably connect and selectively release the first and second engagement members 106*a*, 106*b* to the respective first and second resistance bands 114*a*, 114*b*. The first and second resistance bands 114, 114*b* may have respective first and second handles 116*a*, 116*b* corresponding to respective first and second upper limbs of the user.

The first and second bodily engagement members 106*a*, 106*b* may be secured relative to the platform 102 with respective first and second fastening members 125*a*, 125*b*, e.g., rods made of metal or plastic and having external threads. Alternatively or in addition, first and second fastening members 125*a*, 125*b* may include a spring loaded, locking mechanism to secure the platform 102 to the engagement members 106*a*, 106*b*. The first and second fastening members 125*a*, 125*b* may be configured to pass through apertures along respective axes A and B with respect to the platform 102. The first and second fastening members 125*a*, 125*b* may be secured relative to the lower side of platform 102 with respective nobs 126*a*, 126*b*, e.g., having a plurality of protrusions radially positioned about an outer surface configured to be gripped by the user and an inner surface with internal threads. The first and second middle supports 108*a*, 108*b* may include respective first and second pegs 109*a*, 109*b*, e.g., to be received in corresponding apertures of the platform 102, as discussed in further detail below.

Figure 3A:
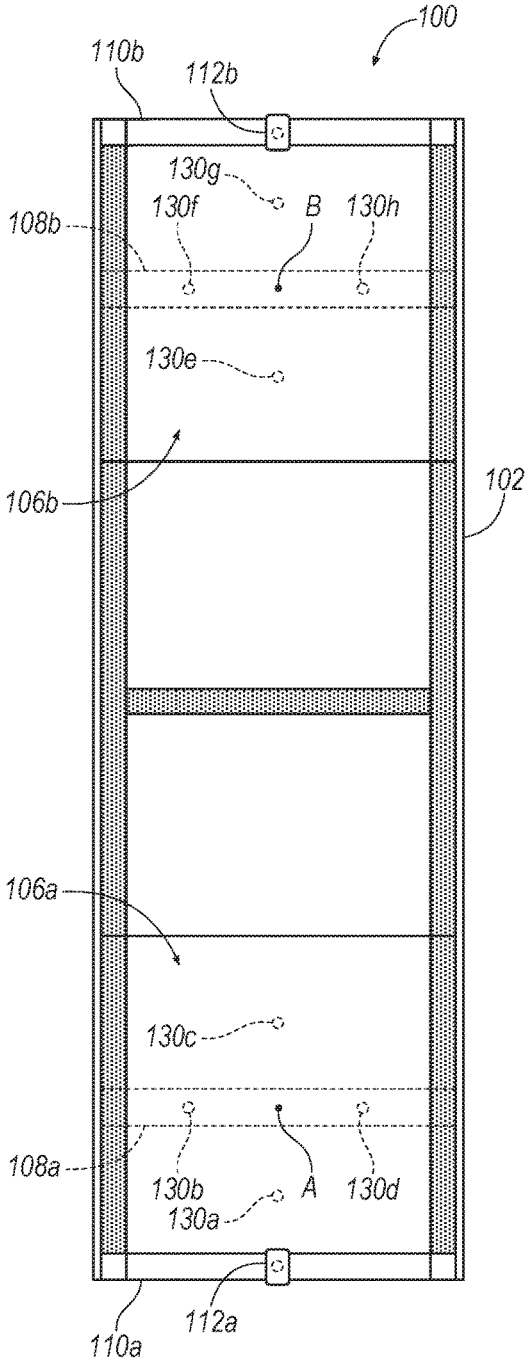
FIG. 3A illustrates a top view of the balance board system, e.g., in an first configuration.
Figure 3B:
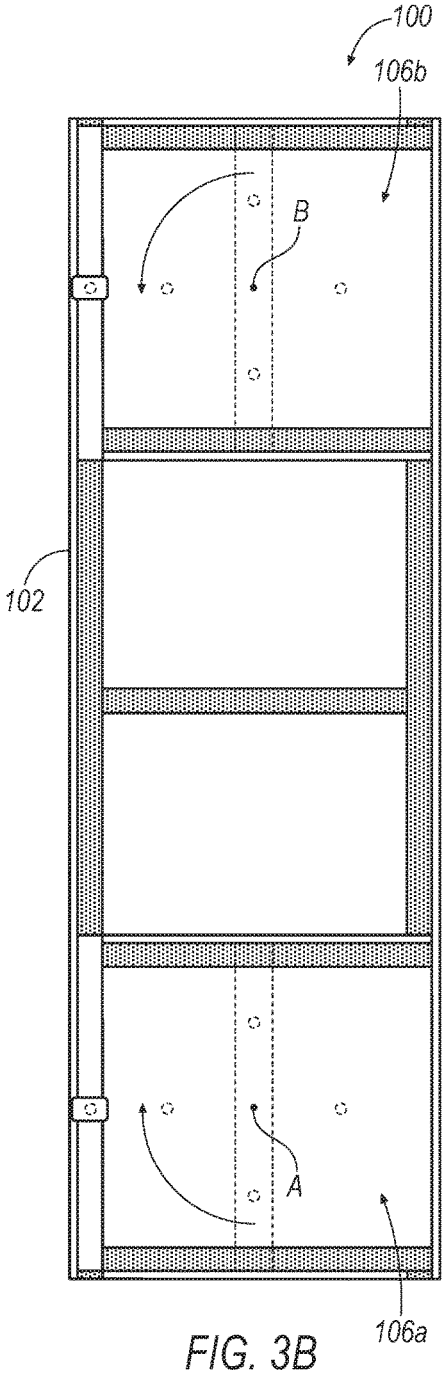
FIG. 3B illustrates an alternative top view of the balance board system, e.g., in a second configuration.

Referring to FIGS. 3A-3B, the first bodily engagement member 106*a* may be configured to rotate about first axis A adjacent the first end of the platform and the second bodily engagement member is configured to rotate about a second axis B adjacent the second end of the platform 102. To secure the first and second bodily engagement members 106*a*, 106*b* in their respective rotational positions, the platform 102 may include apertures 130*a-d* on the first end and 130*e-h* on the second end, e.g., to receive one or a plurality of first and second pegs 109*a*, 109*b* of the first and second middle supports 108*a*, 108*b*. The first and second bodily engagement members 106*a*, 106*b* may be positioned in any rotational increment accommodated by the apertures 130 in platform 102, e.g., providing rotational increments of 15, 30, 45, 90, or 180 degrees. For example, the first and second bodily engagement members 106*a*, 106*b* may have a first configuration as shown in FIG. 3A, e.g., with the first and second upper surfaces 107*a*, 107*b* facing inward and toward each other. As another example, the first and second bodily engagement members 106*a*, 106*b* may have a second configuration as shown in FIG. 3B, e.g., with the first and second upper surfaces 107*a*, 107*b* facing in the same direction and toward a side of the system 100. Alternatively, the first and second bodily engagement members 106*a*, 106*b* may include a third configuration, e.g., with the first and second upper surfaces 107*a*, 107*b* facing outward and away from each other.

Figure 4:
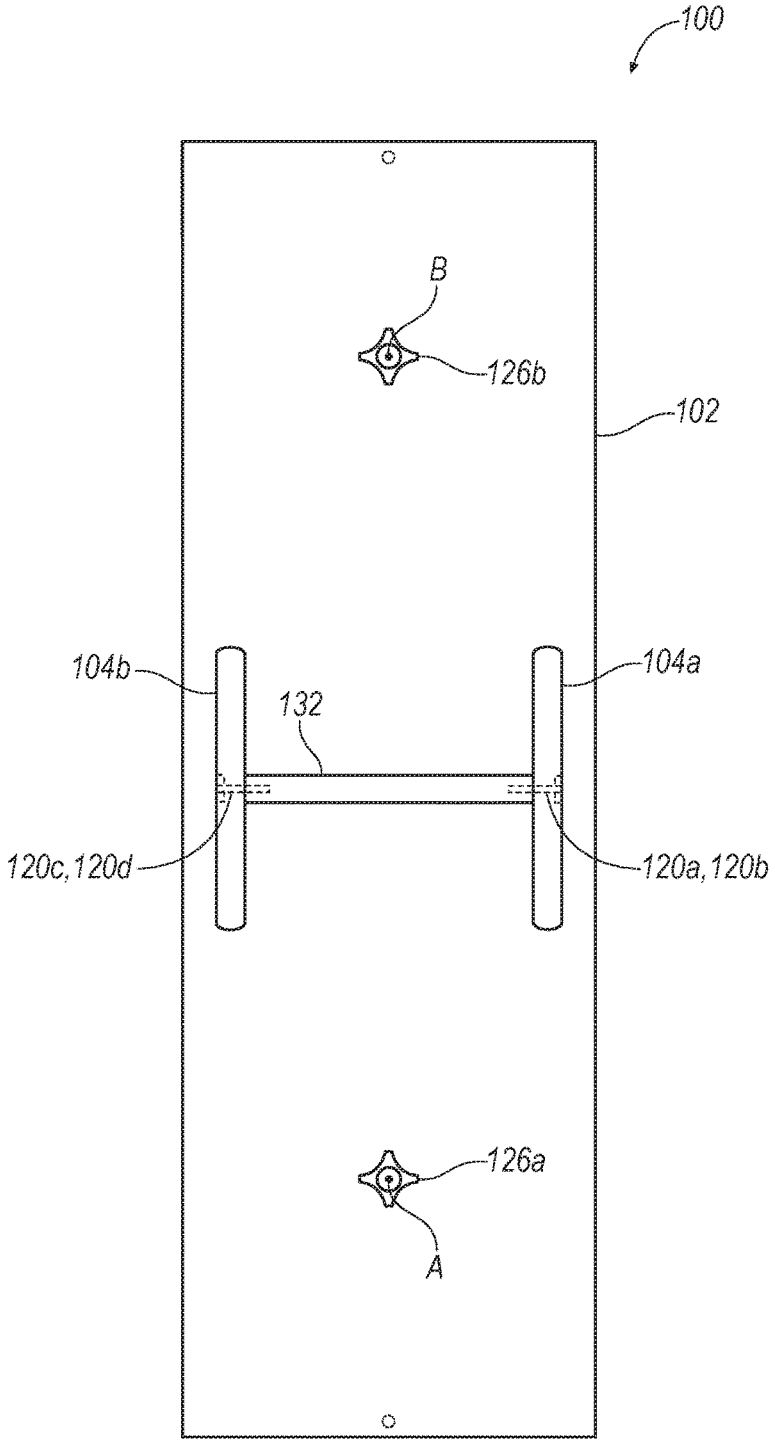
FIG. 4 illustrates a bottom view of the balance board system.
Figure 5:
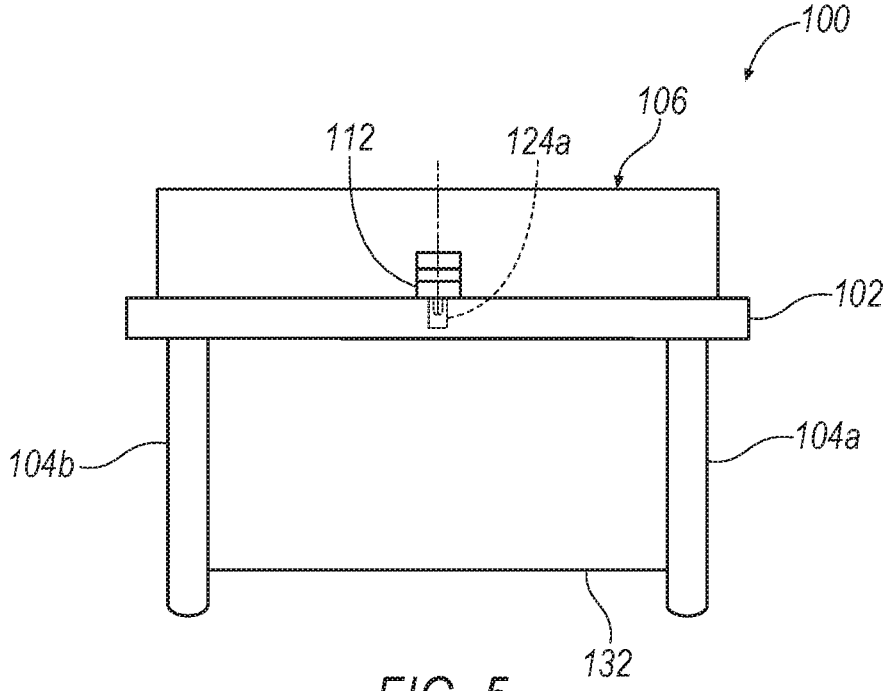
FIG. 5 illustrates a side view of the balance board system.

With reference to FIGS. 4-5, system 100 may include a transverse support 132. The pivot member 104 may include pivot members 104*a*, 104*b*. Transverse support 132 may be positioned on the lower side of the platform 102 and between pivot members 104*a*, 104*b*. Pivot members 104*a*, 104*b* may be secured to the transverse support 132 with respective fasteners 120*a, b* and 120*c, d*.

Figure 6A:
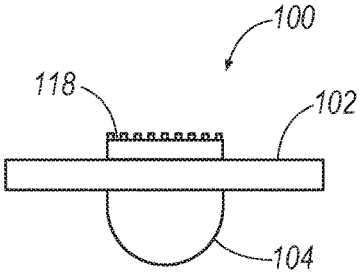
FIG. 6A illustrates an alternative embodiment of the balance board system.

Referring to FIGS. 6A-6G, system 100 may include numerous other embodiments configured to engage various body portions of the user, e.g., a torso, abdomen, buttock, arms, hands, legs, feet, or a combination thereof. As shown in FIG. 6A, system 100 may include platform 102, pivot member 104, and optional pad 118. Pad 118 may be positioned on platform 102 and include a round or rectangular pad having a plurality of protrusions or recesses to optimize engagement with the user. Pad 118 may be configured as an air disk. Exemplary pad materials may include an inflatable elastic material, a foam rubber, closed cell foam, or a combination thereof.

Figure 6E:
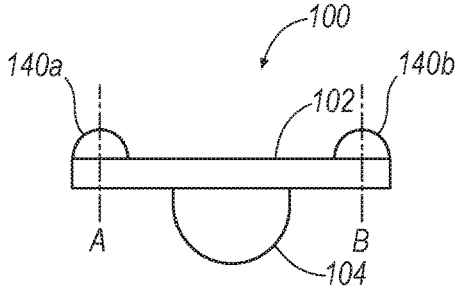
FIG. 6E illustrates an alternative embodiment of the balance board system.
Figure 6B:
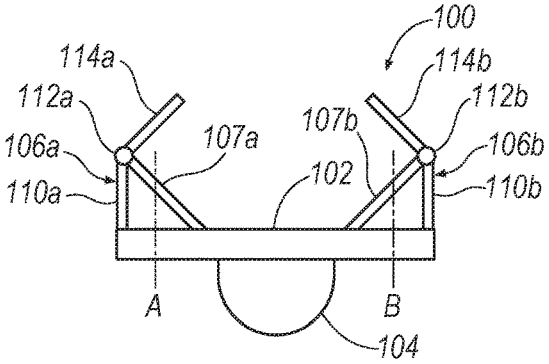
FIG. 6B illustrates an alternative embodiment of the balance board system.
Figure 6F:
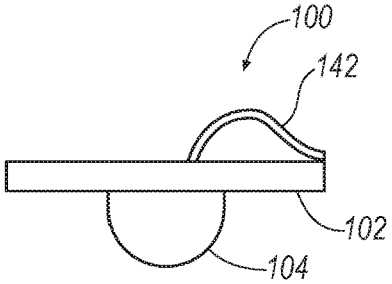
FIG. 6F illustrates an alternative embodiment of the balance board system.
Figure 6C:
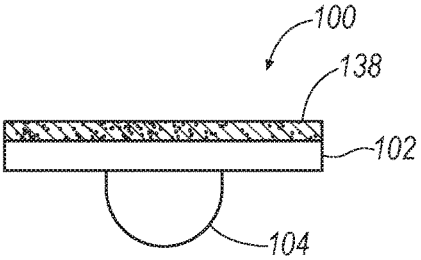
FIG. 6C illustrates an alternative embodiment of the balance board system.
Figure 6G:
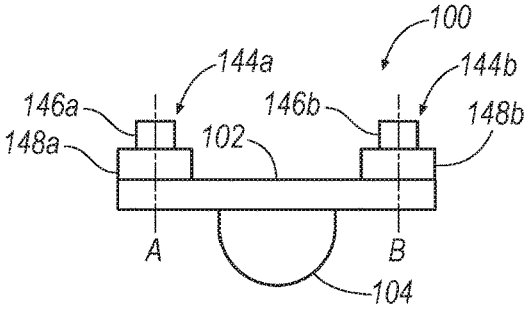
FIG. 6G illustrates an alternative embodiment of the balance board system.
Figure 6D:
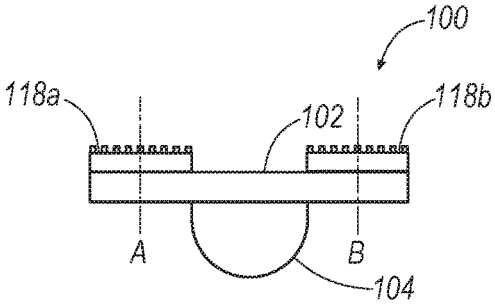
FIG. 6D illustrates an alternative embodiment of the balance board system.

FIGS. 6B-6G illustrate other embodiments for engaging various body portions of the user. As shown in FIG. 6B, system 100 may include first and second engagement members 106*a*, 106*b* having connectors 112*a*, 112*b* with cords or resistance bands 114*a*, 114*b* extending therefrom, e.g., to engage the upper limbs while the lower limbs or feet engage upper surfaces 107*a*, 107*b*. As shown in FIG. 6C, system 100 may include engagement member 138 including a pad having a rectangular shape and extending along the length and width of the upper side of the platform 102. As shown in FIG. 6D, system 100 may include platform 102, pivot member 104, and pads 118*a*, 118 positioned on the respective first and second ends of platform 102. As shown in FIG. 6E, system 100 may include engagement members 140*a*, 140*b* including respective pads having semi-spherical or semi-cylindrical shapes and that are positioned on the first and second ends of the platform 102, e.g., to engage the upper limbs or hands of the user for pushups. As shown in FIG. 6F, system 100 may include engagement member 142 shaped and configured to engage a lower back or abdomen of the user while stabilizing the gluteal muscles. As shown in FIG. 6G, system 100 may include engagement members 144*a*, 144*b* having respective push up bars 146*a*, 146 and respective bases 148*a*, 148*b* that are rotatable about the respective axes A and B, e.g., to engage upper limbs or hands of the user for pushups while allowing rotation to promote a natural range of motion for the wrist.

Methods of using system 100 are also contemplated. A method may include providing a platform 102, a pivot member 104, a first bodily engagement member 106*a*, and a second bodily engagement member 106*b*. The method may further include providing the first and second bodily engagement members at respective incline angles relative to the platform. The method may further include adjusting the include angles of the first and second bodily engagement members. The method may further include engaging a first limb of a user with the first bodily engagement member 106*a*, engaging a second limb of the user with the second bodily engagement member 106*b*; and balancing a body weight of the user about the pivot member 104. The method may further include engaging first and second apertures in the platform 102 with first and second fastening members 125*a*, 125*b*. The method may further include rotating the first engagement member 106*a* about a first axis A adjacent the first end of the platform and rotating the second engagement member 106*b* about a second axis B adjacent the second end of the platform 102. The method may further include pivoting the pivot member with the first and second resistance bands It will be appreciated that the aforementioned method and devices may be modified to have some components and steps removed, or may have additional components and steps added, all of which are deemed to be within the spirit of the present disclosure. None of the components or steps herein are essential elements nor is their interdependency required. Even though the present disclosure has been described in detail with reference to specific embodiments, it will be appreciated that the various modifications and changes can be made to these embodiments without departing from the scope of the present disclosure as set forth in the claims. The specification and the drawings are to be regarded as an illustrative thought instead of merely restrictive thought.

What is claimed is:

1. A balance board system comprising:

a platform having a planar body with upper and lower sides that extend between a first end and a second end, the platform having a central portion between the first and second ends;

a pivot member having a curved bottom surface configured to oscillate along a ground surface, the pivot member being on the lower side and the central portion of the platform;

a first bodily engagement member having a first peg and configured to be positioned in rotational increments by way of the first peg being received in a first aperture of the platform, the first bodily engagement member being on the upper side and adjacent the first end of the platform;

a second bodily engagement member having a second peg and configured to be positioned in rotational increments by way of the second peg being received in a second aperture of the platform, the second bodily engagement member being on the upper side and adjacent the second end of the platform, wherein the first and second bodily engagement members are configured with respective incline angles relative to the platform.

2. The system of claim 1, wherein the first and second bodily engagement members are arranged on opposite sides of the pivot member and to pivot about the pivot member.

3. The system of claim 1, wherein the first and second bodily engagement members are configured to engage first and second limbs of a user and urge the user to stabilize the platform in a level condition, the first and second limbs including at least one of first and second upper limbs and first and second lower limbs.

4. The system of claim 1, wherein the first bodily engagement member includes a first support member having a first fastening member and the second bodily engagement member includes a second support member having a second fastening member, the first and second fastening members being configured to engage respective first and second apertures in the platform.

5. The system of claim 1, wherein the first engagement member is configured to rotate about a first axis adjacent the first end of the platform and the second engagement member is configured to rotate about a second axis adjacent the second end of the platform.

6. The system of claim 1, wherein the first engagement member is configured as a first wedge with a first surface defining a first angle with respect to the central portion of the platform, and wherein the second engagement member is configured as a second wedge with a second surface defining a second angle with respect to the central portion of the platform.

7. The system of claim 1, further comprising a first attachment member connected to the first bodily engagement member and a second attachment member connected to the second bodily engagement member, the first and second attachment members having respective grooves configured to receive respective conical structures of first and second resistance bands, the first and second resistance bands having respective first and second handles corresponding to first and second upper limbs of a user.

8. A balance board device comprising:

a platform having a planar body with upper and lower sides, the platform extending between a first end and a second end, the platform having a central portion between the first and second ends; and a pivot member having a curved bottom surface configured to oscillate along a ground surface, the pivot member being on the lower side and the central portion, wherein the platform includes a first bodily engagement member having a first peg and configured to be positioned in rotational increments by way of the first peg being received in a first aperture of the platform, the first bodily engagement member being on the upper side and adjacent the first end, and the platform includes a second bodily engagement member having a second peg and configured to be positioned in rotational increments by way of the second peg being received in a second aperture of the platform, the second bodily engagement member being on the upper side and adjacent the second end, and wherein the first and second bodily engagement members are configured with respective incline angles relative to the platform.

9. The device of claim 8, wherein the first and second bodily engagement members are arranged on opposite sides of the pivot member and to pivot about the pivot member.

10. The device of claim 8, wherein the first and second bodily engagement members are configured to engage first and second limbs of a user and urge the user to stabilize the platform in a level condition, the first and second limbs including at least one of first and second upper limbs and first and second lower limbs.

11. The device of claim 8, wherein the first bodily engagement member includes a first support member having a first fastening member and the second bodily engagement member includes a second support member having a second fastening member, the first and second fastening members being configured to engage respective first and second apertures in the platform.

12. The device of claim 8, wherein the first bodily engagement member is configured to rotate about a first axis adjacent the first end of the platform and the second bodily engagement member is configured to rotate about a second axis adjacent the second end of the platform.

13. The device of claim 8, wherein the first bodily engagement member is configured as a first wedge with a first surface defining a first angle with respect to the central portion of the platform, and wherein second bodily engagement member is configured as a second wedge with a second surface defining a second angle with respect to the central portion of the platform.

14. The device of claim 8, further comprising a first attachment member connected to the first bodily engagement member and a second attachment member connected to the second bodily engagement member, the first and second attachment members having respective grooves configured to receive respective conical structures of first and second resistance bands, the first and second resistance bands having respective first and second handles corresponding to first and second upper limbs of a user.

15. A method of using a balance board, comprising:

providing a platform, a pivot member, a first bodily engagement member, and a second bodily engagement member, the platform having a planar body with upper and lower sides and that extends between a first end and a second end, the platform having a central portion between the first and second ends, the pivot member having a curved bottom surface configured to oscillate along a ground surface, the pivot member being on the lower side and the central portion, the first bodily engagement member being on the upper side and adjacent the first end of the platform, the second bodily engagement member being on the upper side and adjacent the second end, wherein the first bodily engagement member includes a first peg and is configured to be positioned in rotational increments by way of the first peg being received in a first aperture of the platform, and the second bodily engagement member includes a second peg and is configured to be positioned in rotational increments by way of the second peg being received in a second aperture of the platform;

providing the first and second bodily engagement members at respective incline angles relative to the platform;

engaging a first limb of a user with the first bodily engagement member;

engaging a second limb of the user with the second bodily engagement member; and balancing a body weight of the user about the pivot member.

16. The method of claim 15, further comprising pivoting the pivot member with the first and second bodily engagement members.

17. The method of claim 15, further comprising urging the user to stabilize the platform in a level condition with the first and second bodily engagement members, wherein the first and second limbs include at least one of first and second upper limbs and first and second lower limbs.

18. The method of claim 15, wherein the first bodily engagement member includes a first support member having a first fastening member and the second bodily engagement member includes a second support member having a second fastening member, and further comprising:

engaging first and second apertures in the platform with the first and second fastening members.

19. The method of claim 15, further comprising at least one of:

rotating the first bodily engagement member about a first axis adjacent the first end of the platform; and rotating the second bodily engagement member about a second axis adjacent the second end of the platform.

20. The method of claim 15, further comprising providing a first attachment member connected to the first bodily engagement member and a second attachment member connected to the second bodily engagement member, the first and second attachment members having respective grooves configured to receive respective conical structures of first and second resistance bands, the first and second resistance bands having respective first and second handles corresponding to first and second upper limbs of a user; and pivoting the pivot member with the first and second resistance bands.

* * * * *